United States Patent [19]

Geverath et al.

[11] 4,359,084

[45] Nov. 16, 1982

[54] TEMPERATURE TANK CONTAINER

[75] Inventors: Wulf-Dieter Geverath; Karl-Wilhelm Kundt, both of Hamburg, Fed. Rep. of Germany

[73] Assignees: C.E.M.A.N. Special-Container GmbH, Hamburg; G+. H Montage GmbH, Ludwigshafen, both of Fed. Rep. of Germany

[21] Appl. No.: 143,943

[22] Filed: Apr. 28, 1980

[30] Foreign Application Priority Data

Apr. 28, 1979 [DE] Fed. Rep. of Germany ..... 2917364

[51] Int. Cl.[3] ..... F28F 27/02; F25D 17/04

[52] U.S. Cl. ..... 165/12; 165/47; 165/72; 165/97; 165/135; 62/407; 220/1.5

[58] Field of Search ..... 165/154, 169, 47, 34, 165/97, 102, 135, 80 E, 72; 62/239, 405, 407, 409, 410, 411, 412; 220/1.5; 98/6, 51, 52

[56] References Cited

U.S. PATENT DOCUMENTS

| | | | |
|---|---|---|---|
| 2,550,040 | 4/1951 | Clar | 62/237 X |
| 2,556,418 | 6/1951 | Del Mar | 62/237 X |
| 3,844,203 | 10/1974 | Takahashi | 62/412 X |

FOREIGN PATENT DOCUMENTS

| | | |
|---|---|---|
| 1536368 | 1/1970 | Fed. Rep. of Germany . |
| 7120959 | 5/1971 | Fed. Rep. of Germany . |
| 2212638 | 9/1973 | Fed. Rep. of Germany . |
| 2521820 | 12/1975 | Fed. Rep. of Germany . |
| 2657503 | 6/1978 | Fed. Rep. of Germany . |
| 2816845 | 10/1979 | Fed. Rep. of Germany . |
| 1225325 | 3/1971 | United Kingdom . |
| 1410537 | 10/1975 | United Kingdom . |

*Primary Examiner*—Albert W. Davis
*Assistant Examiner*—Margaret A. Focarino
*Attorney, Agent, or Firm*—Cushman, Darby & Cushman

[57] ABSTRACT

A temperable container with a heat-insulating jacket completely enclosing a tank supported in the container with predetermined passages between the tank and the jacket for conducting a heat transfer medium in forced circulation around the entire outer surface of the tank. An inlet and outlet pass through the jacket to connect to external equipment for supplying the heat transfer medium, and to avoid a short circuit flow from inlet to outlet a partition is provided in the container and has at least one throttleable bypass opening the throttle position of which can be adjusted by a programmable control.

19 Claims, 7 Drawing Figures

TEMPERATURE TANK CONTAINER

Figure 1:
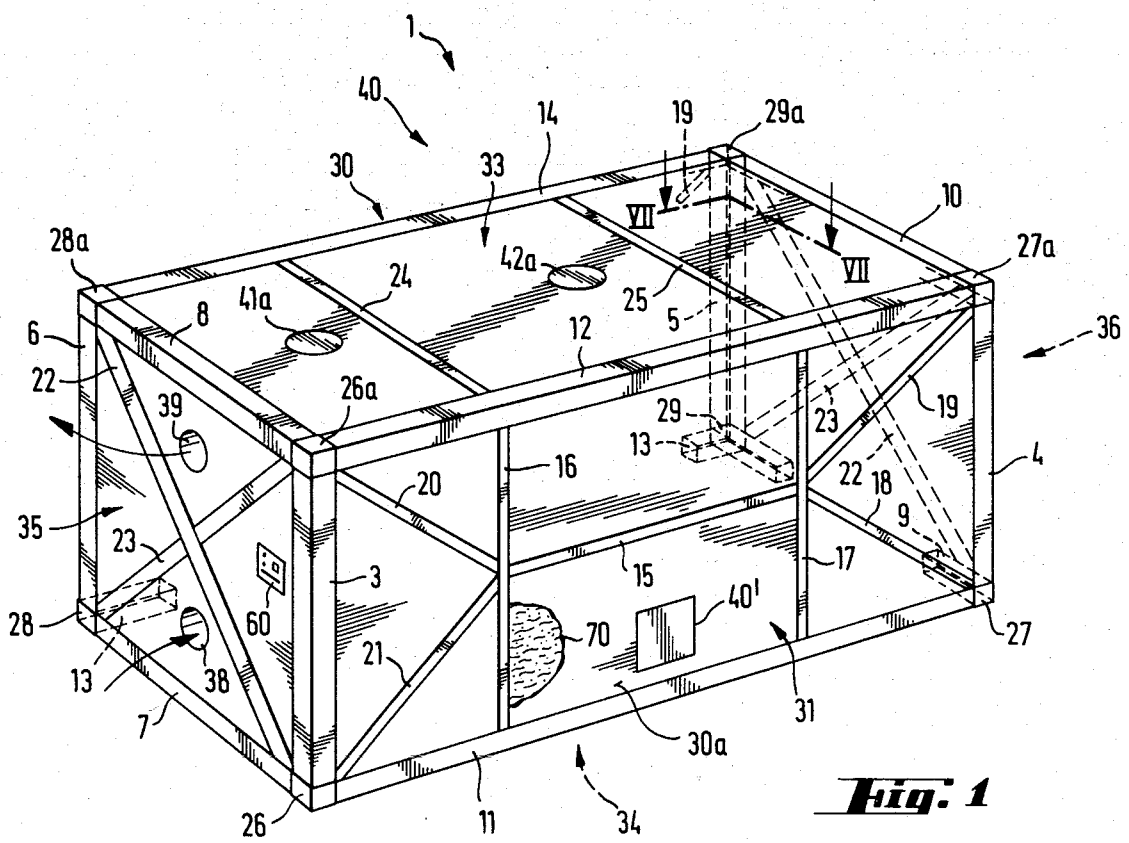

The invention relates to a temperable tank container comprising a support frame having standardised external dimensions of a container for supporting an inner tank comprising a heat-insulating jacket at its outer side, passages being provided between the tank wall and heat-insulating jacket for conducting a cooling or heating medium along the tank wall serving as heat-exchange surface in forced circulation.

Such a tank container is known from German utility model No. 7,120,959. The heat-insulating jacket provided therein serves to heat the tank, for example for transport on ships on deck with low ambient temperatures, and is intended to replace the hitherto usual electrically heated mats with which the tank container was wrapped for heating.

For this purpose, the heat-insulating jacket is disposed cylindrically around the centre portion of cylindrical tank and forms with respect to the tank wall a gap through which the heating medium can flow in forced circulation, acting on the tank wall as heat-exchange surface. The forced circulation is maintained by a fan having a following electrical damper register which is arranged in one of the wedge-shaped gaps between the cylindrical outer periphery of the tank and the support frame in the region of one of the longitudinal edges thereof.

Although with such a tank container it is possible for example at low outer temperatures on the deck to supply to the container content enough heat to prevent the temperature falling below a predetermined minimum temperature, it is not possible to keep the temperature of the tank contents constant independently of changes in the outer temperature because when the heating is in operation considerable temperature differences automatically arise in the tank contents; for whereas the heat supply is in the centre region of the tank the heat dissipation is in the region of the end faces and also the fittings and consequently considerable temperature differences in the tank contents are inevitable. Even when the heating is switched off such temperature differences occur because the centre portion of the tank is insulated and the end faces are not. Consequently, such a tank container is not suitable for transporting temperature-sensitive material, all of which must be kept at an exactly controlled temperature.

An example is the transport of fruit juice concentrate in disposable barrels or vats lined with foils. These vats of iron having a capacity of about 200 liters must, for costs reasons, be made in the immediate vicinity of the fruit juice manufacturer and filled by the latter, whereupon cooling and intermediate storage in refrigeration rooms is carried out at −7° to −18° C. or even less. Until arrival in the consumer country the refrigeration line of the vats must not be interrupted. They are therefore transported e.g. in refrigerated containers or refrigerated wagons to the port, must be intermediately cold stored there and loaded, then being transported on a refrigeration ship; on unloading another intermediate cold storage is necessary as well as refrigerated further transport on land. Not until some days after the first processing are the vats removed from the cooling conditions and then discharged and as a rule, after an intermediate processing, in which various harvesting regions are adjusted to certain flavours, a recooling is necessary, and then refilling of the vats, intermediate storage and further refrigerated transport to bring the refrigerated vats to the bottle filler as final processor. Since it is not economical to transport empty vats, the latter must then be removed, involving further costs; on the other hand, the vats must be manufactured in the country of the fruit juice producer, which usually does not have an efficient metal-producing and metal-processing industry, and frquently the necessary fine sheet metal must be imported. Apart from the considerable expense of constant production and removal of a very large number of such vats, their handling in the refrigerated atmosphere during transport itself using refrigerated containers each containing for example 67 individual vats is exceedingly time-consuming and involves about a half-hour's work for each vat from the first filling to the first emptying. In addition, the emptying of the great number of individual vats with large container area for a given volume of the fruit juice concentrate involves high product losses in discharging, and not only these product losses are expensive in themselves, there is the additional costs of the necessary cleaning work and waste water cleaning due to the high proportion of dissolved decomposable substances in the waste water.

However, all these disadvantages and considerable costs have so far been accepted because it was only possible to obtain adequately accurate temperature control of the fruit juice in refrigerated trucks, refrigerated containers and refrigeration ships, when such juices were filled in metal vats of this type. Although the storage of cylindrical vats in refrigerating compartments of generally rectangular cross section or cold storage dry containers of such cross-section involves relativel high space losses, a cooling is effected over a large surface exposed to the cooling medium, utilising the high easily regulatable cooling capacity of conventional refrigerating compartments and holds, and consequently the temperature can be controlled with adequate accuracy, provided the intermediate transport with fork-trucks or the like at the ports for example can be carried out in correspondingly short times.

In the light of this prior art the problem underlying the invention is to provide a tank container of the type outlined in the preamble of claim 1 with which temperature-sensitive goods such as fruit juice concentrate can be transported without emptying the tank from a supplier overland or by sea to a purchaser and the temperature can be exactly controlled. This problem is solved according to the invention in that the heat-insulating jacket encloses on all sides the tank and at end walls of the support frame also has a passage-forming distance from the tank wall in such a manner that the cooling or heating medium sweeps round the entire free outer surface of the tank wall.

It has surprisingly been found that in spite of the large volume of a tank container compared to the surface area, having a capacity of over 20 tons, in the interior for example a 20 foot container adequately powerful and in particular adequately homogeneous cooling of the tank content can be achieved if the cooling medium due to these features flushes the entire outer surface of the tank wall, with the exception of only the necessary substantially linear tank supports, and if the heat-insulating jacket encloses the entire tank and the cooling medium. Of course, the same applies to a corresponding heating of the tank content with a heat medium. Due to the provision of the laminate arrangement tank wall-cooling or heating medium-heat insulation at practically every point of the outer surface of the tank once a temperature of the tank content has been reached said temperature can be maintaine practically as long as desired unchanged and homogeneously, with a control accuracy of fractions of a degree Kelvin. Since all the fittings of the tank are at least included in the heat insulation, if not flushed by the heating or cooling medium, at least as far as their functionability allows for such containment, in the regions of the fittings as well no detrimental temperature fluctuations occur outside a predetermined narrow temperature range. Furthermore, by changing the temperature of the heating or cooling medium exactly controlled temperature changes can be produced; in the case of fruit juice this may be a desired raising of the temperature to prepare for emptying, or whenever this is necessary for other reasons.

Particular advantages are achieved when an individual supply with heating or cooling medium by means of an individual unit, i.e. a so called integrated unit, is not provided for each tank container, but on the contrary at one end face of the tank container inlets and outlets are provided for connection to a stationary or ship's circulating means for heating or cooling medium. Such means are in use and known for example from German published specification No. 2,212,638. Stacked containers in stacks of up to six containers are connected by end-face inlets and outlets via couplings to cooling columns or cooling rods which provide the supply with cooling medium, or if necessary of course with heating medium. An example of such containers and their possible arrangement can be seen for example in German publish specification No. 1,536,368 and German specification as laid open to inspection No. 2,657,503 provides examples of couplings for connection of the containers to the central supply system. This existing system, which has a number of important advantages, could be used to make cooling or heating connections available for the containers along their transport path from the supplier to the purchaser, both on land and on a ship, and even already installed systems might possibl be employed. In any case, advantageous use may be made of the already sophisticated plant technique and corresponding equipment because the tank containers according to the invention may be handled exactly like conventional refrigerated containers with corresponding connections; practically no new requirements arise, particularly since a tank container according to the invention need hardly differ externally from a conventional refrigerated container.

The subsidiary claims relate to further advantageous developments of the invention.

Figure 2:
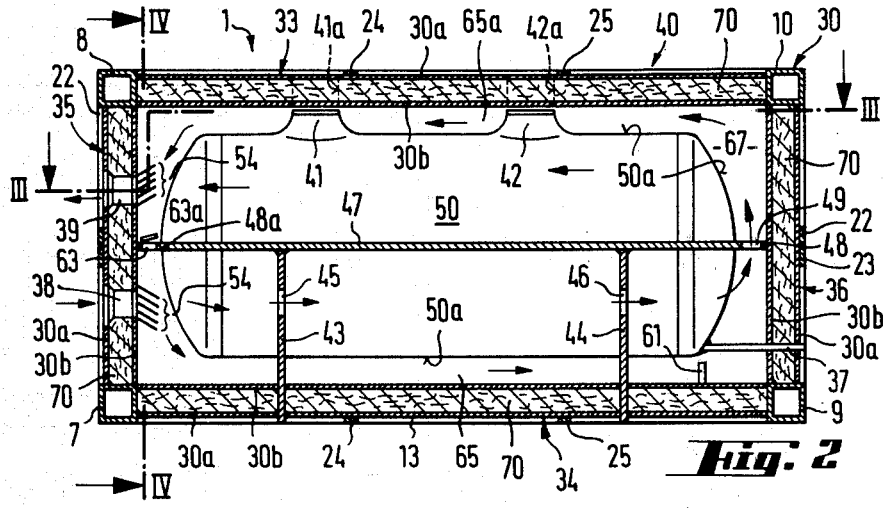
Figure 3:
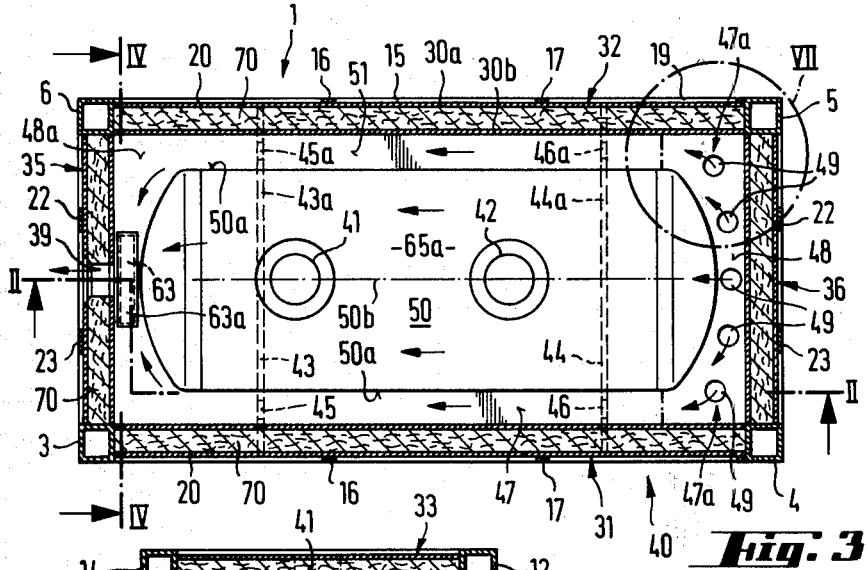
Figure 4:
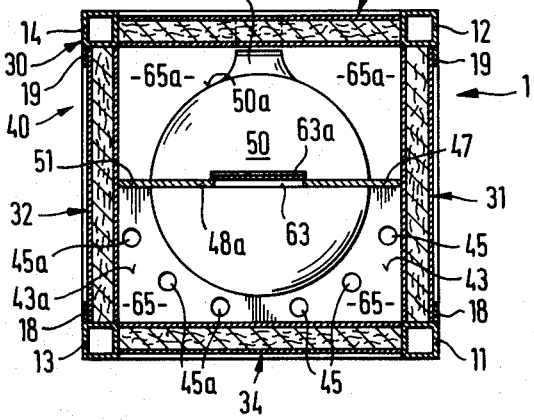
Figure 5:
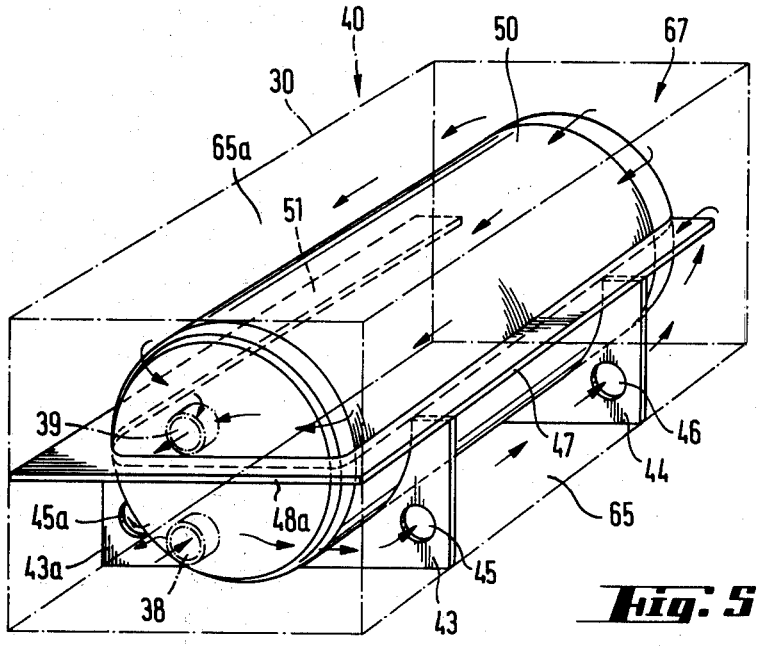
Figure 7:
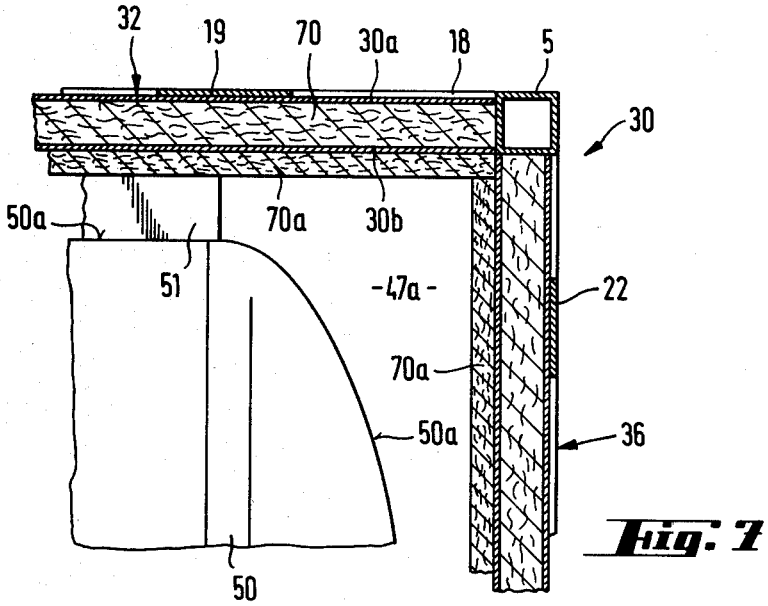
Figure 6:
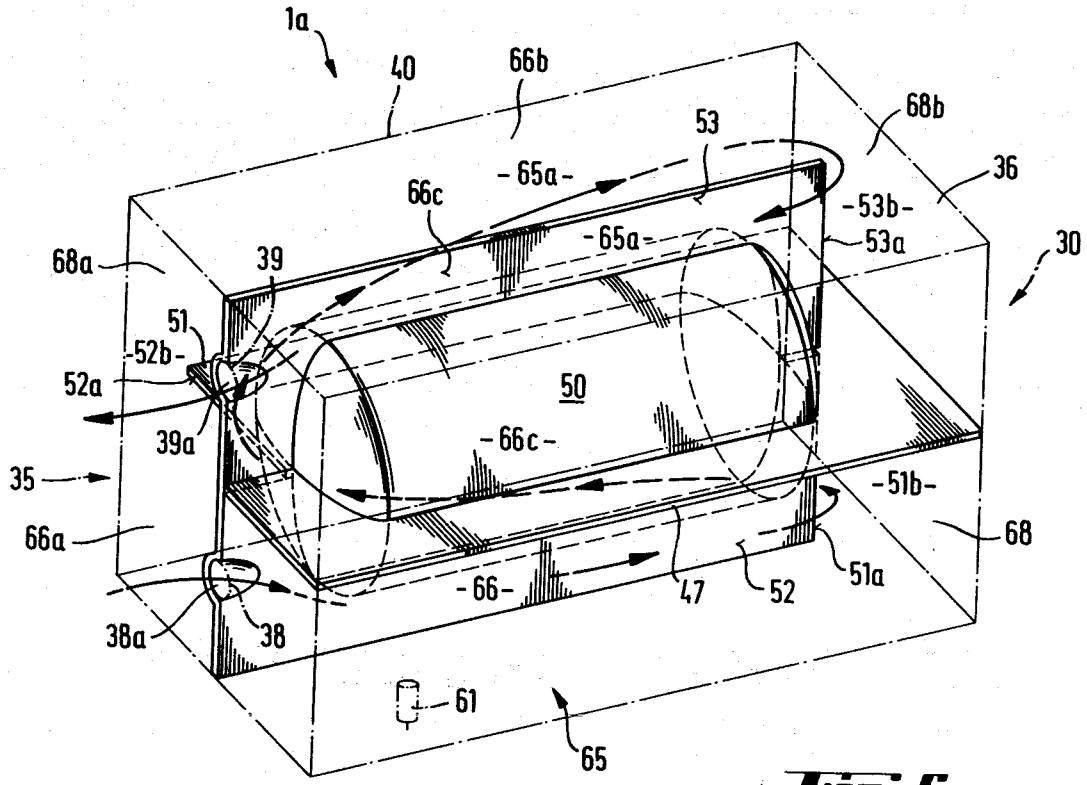

Further details, features and advantages of the invention will be apparent from the following description of embodiments with the aid of the drawings, wherein:

FIG. 1 shows an embodiment of a tank container according to the invention in perspective, FIG. 2 shows the tank container of FIG. 1 from the side in section along the line II—II of FIG. 3, FIG. 3 shows the tank container of FIG. 1 from above in section along the line III—III of FIG. 2, however with deletion of the flow deflection means, FIG. 4 shows the tank container of FIG. 1 from an end face in section along the lines IV—IV of FIGS. 2 and 3, FIG. 5 shows the air path round the tank of the container according to FIG. 1 in a schematic perspective illustration, FIG. 6 shows another embodiment of a tank container according to the invention in a schematic perspective illustration and, FIG. 7 shows to an enlarged scale of a fragment of the tank container of FIG. 1 in the region of a vertical spar corresponding to the circle VII of FIG. 3 but in a further modified embodiment.

The tank container 1 illustrated in FIG. 1 comprises a trusswork support frame 30 in which the actual tank, not shown, is disposed. Between four bottom corner fittings 26, 27, 28 and 29 longitudinal spars 11 and 13 and transverse spars 7 and 9 (cf. also FIGS. 2 to 4) are disposed. Supported on the bottom corner fittings 26, 27, 28 and 29 are vertical spars 3, 4, 5 and 6 whose upper corner fittings *26a, 27a, 28a* and *29a* are connected together by means of transverse spars 8 and 10 and longitudinal spars 12 and 14. In the top wall 33 and the bottom wall 34 transverse struts 24 and 25 are disposed between the longitudinal spars 12 and 14 and 11 and 13 respectively. At the end walls 35 and 36 diagonal struts 22 and 23 are disposed in the manner of a cross. At the side walls 31 and 32 between the upper and lower longitudinal spars 13 and 14 and 11 and 12 respectively vertical struts 16 and 17 are provided which are connected by means of diagonal struts 18, 19, 20 and 21 to the vertical spars 3, 4, 5 and 6 and the longitudinal spars 11, 12, 13 and 14. A longitudinal strut 15 is arranged between the vertical struts 16 and 17 about half-way up in each case. The arrangement for supporting the forces acting from the tank 50 (cf. FIGS. 2 to 4) on the support frame 30 corresponds to the principles of German specification laid open to inspect No. 2,816,845, to which express reference is made for further details in this respect, and the disclosure of which is herein incorporated by this reference. The tank 50 disposed in the support frame 30 is surrounded by a heat-insulating jacket 40 which in the example consists of fillings with heat-insulating material 70 disposed in the trusswork support frame 30. As apparent in particular from FIGS. 2 to 4, the tank comprises at its upper side fittings in the form of a tank dome 41 and a manhole cover 42 which are also disposed in the interior enclosed by the heat-insulating jacket 40. In the top wall 33 access openings *41a* and *42a* to the tank dome 41 and manhole cover 42 are provided which can each be closed by a cover corresponding in structure to the top wall 33, and said cover may for example be provided with a customs seal by means of a lead sealable toggle catch, but this is not shown in detail.

At the end wall 35 in the example of embodiment an inlet 38 and outlet 39 for passing a heat transfer forming medium, i.e., a cooling or heating medium are provided vertically above each other and may be made sealable in a manner not illustrated by means of a quick-action fastener, as known per se. Furthermore, at the end wall 35 a control panel 60 is illustrated with control members for control means for maintaining the temperature in the interior of the heat-insulating jacket 40.

As apparent in particular from FIGS. 2 to 4, between the heat-insulating jacket 40 formed by filling the wall faces of the support frame 30 with heat-insulating material 70 and the outer tank wall *50a* of the tank 50 lateral separating webs 47 and 51 are provided at the level of the longitudinal centre axis *50b* of the tank 50. The lateral webs 47 and 51 are disposed in the section of FIG. 4 as it were in the equatorial plane of the circularly cylindrical tank 50 and divide the interior between the tank wall *50a* and the heat-insulating jacket 40 into a lower passage 65 and an upper passage 65*a*. The separating webs 47 and 51 may be thermally conductively connected to the tank wall 50*a* and thus act to a certain extent as additional heat-exchange areas; of course, the outside of the tank wall 50*a* may otherwise be formed to promote the heat transfer from the passages 65 and 65*a* on the tank 50 and provided for example with ribs or the like if in an individual case intensification of the heat transfer in the region of the tank wall 50*a* is desired.

Instead of the lateral separating webs 47 and 51, any desired other configuration of a division into the passages 65 and 65*a* over the length of the tank 50 may be chosen. The width of the tank 50 may also be chosen so that on both sides linear contact exists between the inside of the heat-insulating jacket 40 and the side walls 31 and 32, resulting in the desired division in this manner and also facilitating locating of the tank 50 in the support frame 30.

The lower passage 65 in the example of embodiment is connected to the inlet 38 whilst the upper passage 65*a* is connected to the outlet 39, as apparent in particular from FIGS. 2 and 5.

To form a flow deflection zone 67, in a common portion 48 of the separating webs 47 and 51 in the region of the end wall 36 opposite the inlet and outlet 38 an 39 openings 49 are formed through which the cooling or heating medium can pass from the passage 65 to the passage 65*a*. Instead of a common web portion 48 with openings 49, each lateral web 47 and 51 may terminate at a corresponding distance in front of the heat-insulating jacket in the region of the end wall 36 and thus form a tranfer passage 47*a* by the spacing between the tank wall 50*a* and the heat-insulating jacket 40 in the region of the end wall 36 as well as shown in FIG. 3 in dashed line and in full line in FIG. 7.

In every case the tank 50 requires some form of support means for securing in the support frame 30; in the case of a tank 50 with dimensionally stable tank wall 50*a* in particular saddles 43, 43*a*, 44, 44*a* are possible, their location being apparent in particular from FIGS. 2 and 5. The support means for example in the form of the saddles 43, 43*a*, 44 and 44*a* must then have openings 45, 45*a*, 46 and 46*a* of suitable form which in the example of embodiment illustrated are formed as holes in the saddles 43, 43*a*, 44 and 44*a* to permit a flow of the cooling or heating medium parallel to the longitudinal centre axis 50*b* of the tank 50 in the lower passage 65. In the case of a non-linear support by saddles 43, 43*a*, 44, 44*a*, i.e. a substantially flat support with non-dimensionally stable tank wall 50*a*, corresponding perforations may be provided in the support so that the tank wall 50*a* can be subjected to the cooling or heating medium.

The resulting flow path of the cooling or heating medium in a tank container 1 according to FIG. 1 to 4 is shown in FIG. 5. The medium, e.g. cooling air, flows through the inlet 38 and on passing through the passage 65 sweeps over the lower portion of the tank wall 50*a*. In the region of the flow deflection zone 67 the cooling air is then deflected upwardly through 180° and sweeps over the upper portion of the tank wall 50*a* in the passage 65*a*, thereafter leaving by the outlet 39. Of course, the flow can be conducted if necessary in individual regions by suitable conventional deflection means. Thus, for example, a manifold not illustrated may be associated with the inlet 38 or outlet 39 to obtain a more uniform flow over the cross-section of the passages 65 and 65*a*. A marked short-circuit flow along the inside of the end wall 35 of the support frame 30 can be avoided either by the flow deflection means indicated at 54 in FIG. 2, deflecting the flow from the inlet 38 downwardly and promoting a flow from the upper passage 65*a* to the outlet 39, or a partition 48*a* may be provided between the inlet 38 and the outlet 39 substantially in the extension of the lateral webs 47 and 51 and can completely prevent a short-circuit flow. The provision of such a partition 48*a* has the additional advantage that a bypass opening 63 may be provided therein which is throttable in suitable manner. For this purpose, a separate throttling means 63*a* can be associated with the bypass opening 63 or alternatively by means of setting the flow deflection means 54 a variable proportion of the flow may be conducted through the bypass opening 63, the throttle means 63*a* and/or the flow deflecting means 54 being adjustable from the control means in dependence upon the temperature in the interior of the heat-insulating jacket 40 in such a manner that a greater or lesser proportion of the cooling or heating medium supplied via the inlet 38 is conducted without flowing round the main body of the tank 50 through the bypass opening 63 in the manner of a short-circuit flow directly back again to the outlet 39.

It has been found that with the above arrangement in spite of the large volume of the—in the example of embodiment—single tank 50 within the heat-insulating jacket 40 the temperature of the goods in the tank 50, for example fruit juice concentrate, can be kept exceedingly constant, as can that of other liquids, granulates or the like, and a sensitivity of the temperature control of about 0.1° K. is readily obtainable. This is surprising because when the support frame 30 has the dimensions of a 20 foot container the tank 50, for a weight of about 24 t, has a comparatively small heat-exchange area in the form of the tank wall 50*a* of only about 42 $m^2$. However, particularly when connected to an external supply system via the inlet 38 and the outlet 39 a high air exchange can be obtained with a relatively large air volume between the tank wall 50*a* and the heat-insulating jacket 40, for example, about 80 air exchanges per hour, and consequently the desired temperature setting and maintaining of a constant temperature can be achieved by such a permanent all-round flushing with a generous amount of air at an exactly controlabl temperature. However, fundamentally the use of a so called integrated unit instead of connection to an external supply system would be possible but would have the disadvantage that the tank 50 would have to be reduced in size to make room for example for a refrigeration unit, thus diminishing the transport capacity. In addition, the relatively expensive refrigeration units have a comparatively high weight and consequently the useful load would be reduced.

The heat-insulating material 70 may be mineral fibrous materia such as glass wool, or foam such as polyurethane hard foam. As apparent in particular from FIG. 7 the heat-insulating material 70 may be accommodated in hollows in the wall faces of the support frame 30; an outside covering with a sheet metal wall 30*a* may be advantageous, for instance of the type employed in conventional containers, so that there are hardly any differences in the external appearance. If an inner covering of the heat-insulating material 70 with an inner shet metal wall 30*b* is provided, i.e. the face is made double-walled, any non-self-supporting heat-insulating materials 70 may be readily employed, including plastic granulates or the like. However, in this case as well as heat-insulating material 70 a material on a mineral fibrous basis in the form of plates or sheets is preferred. An increased insulating thickness can be achieved if required by applying on the inside of a first layer of heat-insulating material 70 or the inside of the sheet metal wall 30*b* a second layer 70*a* of heat-insulating material which may have a different consistency to the heat-insulating material 70 of the first layer. In the embodiment according to FIG. 7 for example additional mineral fibre plates may be applied to form the layer 70*a* to the inside of the sheet metal wall 30*b*. The walls 30*a* and 30*b* may also consist of suitable material different from usual sheet metal; so an outer wall 30*a* made of water-proof plywood has proved adequate for this purpose.

An alternative embodiment of a tank container 1*a* is illustrated diagramatically in FIG. 6, the same reference numerals being used for the same or directly corresponding components. This embodiment differs from that according to FIGS. 1 to 6 substantially in that additionally to the lateral separating webs 47 and 51 vertical webs 52 and 53 are provided which divide the lower passage 65 into two adjacent sub-passages 66 and 66*a* and the upper passage 65*a* into corresponding sub-passages 66*b* and 66*c*. The cooling or heating medium passes through the inlet 38 via a flow guide means 38*a* into the passage 66 and in the region of the opposite end wall 36 of the tank container 1*a* is deflected in a flow deflecting zone 68 in a substantially horizontal plane through 180° into the passage 66*a*, an opening 51*b* being provided between the passage 66 and the passage 66*a*, said opening being formed between the inside of the end wall 36 and the adjacent setback edge 51*a* of the vertical separating web 52. In the passage 66*a* the cooling or heating medium flows in the opposite direction to the passage 66 back to the region of the end wall 35 of the tank container 1*a* where in a flow deflecting zone 68*a* in a vertical plane a flow deflection through again 180° C. takes place into the passage 66*b*. For this purpose, the adjacent edge 52*b* of the web 51 is set back accordingly so that between the edge 52*a* and the inside of the end wall 35 of the tank container 1*a* a corresponding substantially slot-shaped transfer opening 52*b* for the flow deflecting zone 68*a* results. In the upper passage 66*b* the cooling or heating medium again flows in the opposite direction to the passage 66*a* back to the region of the end wall 36 where, as it were in a plane above the flow deflecting zone 68, another deflection through 180° takes place in the region of a flow deflecting zone 68*b* into the passage 66*c*. The rear edge 53*a* of the web 53 is in alignment with the edge 51*a* of the web 52 so that in the region of the flow deflecting zone 68*b* a corresponding opening 51*b* for the transfer of the medium results. From the passage 66*c* the cooling or heating medium passes via a flow guide means 39*a* to the outlet 39 again.

In the embodiment of FIG. 6 the distance covered by the flow in the interior of the heat-insulating jacket 40 is doubled so that by increased flow rate and increased turbulences of the cooling or heating medium an improved heat transfer to the tank wall 50*a* is obtained.

If particularly high air exchanges are required, it may be advantageous to dispose in the interior of the heat-insulating jacket 40 tube or hose lines extending parallel to the centre longitudinal axis 50*b* of the tank 50 and comprising outlet nozzles and inlet openings which are connected to the inlet 38 and outlet 39 respectively and arranged so that the flushing of the tank wall 50*a* obtained is as complete and intensive as possible. By corresponding formation of the tank wall 50 for a global or local influencing of the heat-transfer all desired adaptations to the requirements of an individual case can be obtained. Even separating webs arranged at the periphery of the tank wall 50*a* need not extend rectilinearly but may be disposed spirally or in any other suitable manner.

By using the throttlable bypass opening (63 cf. FIGS. 2 to 4) by suitable control means individual adaptation of an individual tank container 1 or 1*a* in a stack to desired temperature conditions is moreover possible, i.e. in spite of a common external supply with cooling or heating medium the exact desired temperature can be set individually for each tank 50. For this purpose, at suitable locations in the interior of the heat-insulating jacket 40 temperature sensors 61 are disposed as illustrated diagrammatically in FIGS. 2 and 6, and of course if necessary a direct monitoring of the temperature of the content of the tank 50 for influencing the automatic control can be conducted.

The complete surrounding and enclosing of the tank 50 by the heat-insulating jacket 40 also has the special advantage that the space between the inside of the heat-insulating jacket 40 and the tank wall 50*a* may be used as control space and thus provide additional reliability. For this purpose, at the inside of the bottom wall 34 a corresponding sensor, not illustrated in detail, can be arranged which responds to leakage of the tank, and furthermore if necessary a correspondingly formed temperature sensor 61 may be used for this purpose as well. This enables leakage of the tank 50 to be detected immediately and counter measures can be adopted before the regions outside the control space or the heat-insulating jacket 40 or the support frame 30 have been damaged by the leakage.

The fact that all the fittings such as tank dome 41, manhole cover 42 and corresponding outlet 37 (cf. FIG. 2) are surrounded by the heat-insulating jacket 40 and flushed by the heating or cooling medium eliminates any transport damage which could otherwise arise in cases where although the major part of the transported goods is held at the correct temperature a small part, for instance in the region of fitting is not so that any decomposition or the like at these points infects the remaining tank content or when the remaining tank content is heated an ice plug or the like occurs at such points.

In the region of the opening 41*a* on the tank dome 41 means, not illustrated, are provided to avoid any spilling of the filling liquid or the like in the space between the tank wall 50*a* and the heat-insulating jacket 40. Furthermore, preferably a plurality of customs inspection openings 40' is provided in the heat-insulating jacket, through which openings the interior of the heat-insulating jacket 40 is accessible from the outside for inspection purposes. The inspection openings 40' are, in a manner not illustrated, provided with detachable covers, sealable with a customs seal.

We claim:

1. Temperable tank container comprising:

a support frame including a heat-insulating jacket at its outer side and having standardised external dimensions of a container for supporting an inner tank so that the outer wall of the tank is spaced from said heat-insulating jacket to provide passages between the tank wall and heat-insulating jacket for conducting a heat transfer medium in forced circulation along the tank wall serving as heat-exchange surface, said heat-insulating jacket being disposed to encompass said tank and being spaced at end walls of the support frame from the tank wall to form further passages connected in such a manner with the first mentioned passages that said medium sweeps round the entire free outer surface of the tank wall, characterised in that the intermediate space between the heat-insulating jacket and the tank wall is divided at least in a horizontal plane over the entire tank length, and that beneath said plane at least one passage with the flow of said medium in one direction is provided and above said plane at least one other passage with flow of said medium in the opposite direction is provided.

2. Tank container according to claim 1, characterised in that at one wall (35) of the tank container **(1;1*a*) an inlet and outlet (38,39) passing through the heat-insulating jacket (40)** are provided for connection to an external supply means for said medium.

3. Tank container according to claim 1, or 2, characterised in that the heat-insulating jacket (40) is secured to the support frame (30).

4. Tank container according to claim 1 or 2 characterised in that the heat-insulating jacket (40) is disposed at least approximately parallel to the planar wall faces of the support frame (30).

5. Tank container according to claim 4, characterised in that the heat-insulating jacket (40) is disposed in the wall faces of the support frame (30).

6. Tank container according to claim 5, characterised in that the heat-insulating jacket (40) is covered at least at its outside by sufficiently rigid walls **(30*a*)** made of sheet metal like steel, or of other water-proof materials like water-proof plywood which are arranged in the position of conventional walls of standardised containers.

7. Tank container according to claim 1, characterised in that at least at the side of the tank (50) opposite the inlet and outlet (38,39) a flow deflection zone **(67; 68, 68*b*) is provided for transfer of the said medium between oppositely traversed passages (65, 65*a*; 66, 66*a*; 66*b*, 66*c* respectively)**.

8. Tank container according to claim 7, characterised in that the support frame includes saddle means for supporting the tank and having openings for passage of the said medium.

9. Tank container according to claim 7, characterised in that to avoid a short-circuit flow connection between the inlet (38) and the outlet (39) a partition **(48*a*) is provided which has at least one throttlable bypass opening (63)**.

10. Tank container according to claim 9, characterised in that the throttle position of the bypass opening (63) can be adjusted by means of a programmable control means with which the container is provided.

11. Tank container according to claim 1, characterised in that the heat-insulating jacket (40) forms the wall of a control space surrounding the tank (50).

12. Tank container according to claim 1, characterised in that there is provided at least one customs inspection opening (40'), which is sealable with a customs seal, through which the space between the tank wall **(50*a*) and the heat-insulating jacket (40)** is accessible from the outside.

13. Temperable tank container comprising:

a support frame including a heat-insulating jacket at its outer side and having standardised external dimensions of a container for supporting an inner tank so that the outer wall of the tank is spaced from said heat-insulating jacket to provide passages between the tank wall and heat-insulating jacket for conducting a heat transfer medium in forced circulation along the tank wall serving as heat-exchange surface, said heat-insulating jacket being disposed to encompass said tank and being spaced at end walls of the support frame from the tank wall to form further passages connected in such a manner with the first mentioned passages that said medium sweeps round the entire free outer surface of the tank wall, characterised in that at preferably one end wall of the tank container an inlet and outlet passing through the heat-insulating jacket are provided for connection to an external supply means for said medium, and being further characterised in that to avoid a short-circuit flow connection between the inlet and the outlet a partition is provided which has at least one throttlable bypass opening.

14. Tank container according to claim 13, characterised in that the throttle position of the bypass opening can be adjusted by means of a programmable control means with which the container is provided.

15. A container for containing a tank of the type having a plurality of fittings providing for access to the tank interior, comprising:

a support frame including a heat-insulating jacket at its outer side and having standardised external dimensins of a container for internally supporting said tank so that the outer wall of the tank is spaced from said heat-insulating jacket to provide passages between the tank wall and heat-insulating jacket for conducting a heat transfer medium in forced circulation along the tank wall serving as heat-exchange surface, said heat-insulating jacket being disposed to encompass said tank and its said fittings and being spaced at end walls of the support frame from the tank wall to form further passages connected in such a manner with the first mentioned passages that said medium sweeps round the entire free outer surface of the tank wall.

16. A container as in claim 15, wherein there are removable cover means in said heat-insulating jacket at the places of said fittings for ready external access through said jacket to the interior thereof for accessing said tank fittings.

17. Tank container according to claim 16, characterised in that at one wall of the tank container an inlet and outlet passing through the heat-insulating jacket are provided for connection to an external supply means for said medium.

18. Tank container according to claim 17, characterised in that to avoid a short-circuit flow connection between the inlet and the outlet a partition is provided which has at least one throttlable bypass opening.

19. Tank container according to claim 18, characterised in that the throttle position of the bypass opening can be adjusted by means of a programmable control means with which the container is provided.

* * * * *